United States Patent [19]

Lonnebring

[11] 4,028,025

[45] June 7, 1977

[54] SCREW PUMP

[75] Inventor: Arne Lonnebring, Alvsjo, Sweden

[73] Assignee: Aktiebolaget Imo Industre, Stockholm, Sweden

[22] Filed: Apr. 30, 1976

[21] Appl. No.: 682,164

[30] Foreign Application Priority Data

May 2, 1975 Sweden ..... 7505141

[52] U.S. Cl. ..... 418/197; 418/203; 308/187.1; 277/207 R

[51] Int. Cl.[2] ..... F04C 1/10; F16C 33/74; F16J 15/08

[58] Field of Search ..... 418/197, 201, 203; 415/96, 104–107; 308/187.1; 277/207 R, 236, DIG. 10

[56] References Cited

UNITED STATES PATENTS

| | | | |
|---|---|---|---|
| 2,095,167 | 10/1937 | Burghauser | 418/203 |
| 2,592,476 | 4/1952 | Sennet | 418/203 |
| 2,947,021 | 8/1960 | Black | 308/187.1 |
| 3,432,177 | 3/1969 | Colwell | 277/207 |

FOREIGN PATENTS OR APPLICATIONS

| | | | |
|---|---|---|---|
| 894,768 | 3/1944 | France | 418/197 |
| 1,304,232 | 8/1962 | France | 277/236 |
| 672,700 | 3/1939 | Germany | 418/197 |

*Primary Examiner*—John J. Vrablik
*Attorney, Agent, or Firm*—Haseltine, Lake & Waters

[57] ABSTRACT

A screw pump having a unit which includes a drive screw and at least one impeller screw that meshes therewith, arranged within a casing that sealingly encloses the screws, each impeller screw on the pressure side being provided with a pin mounted in a sleeve, the interior of which communicates with the suction side through channels in a pump housing and the drive screw. There is a disc-like packing between an end surface of each sleeve and an end wall that closes the pressure side of the housing, through which end wall the channels partially extend, and through which a drive shaft is extended for the drive screw. The invention provides that each sleeve has one or more deformation zones on a side thereof remote from the packing, and facing a fixed surface in the housing, which zones are arranged to abut the fixed surface in the housing.

1 Claim, 4 Drawing Figures

SCREW PUMP

The present invention relates to a screw pump having a drive screw and two or more impeller screws engaging therewith and mounted in a housing surrounding the screws, the impeller screws being hydraulically balanced by the fact that the ends thereof located adjacent to the pressure side of the pump are in communication with the pressure prevailing on the suction side, through passages or channels arranged in the pump housing and in the drive screw. More specifically, the invention relates to a sealing device which seals between two portions of the pump housing through which the passages extend.

More specifically, for achieving the intended function, the ends of the impeller screws located on the pressure side are provided with pins which are mounted in sleeves arranged in corresponding ends of the housing. An end wall closes the end of the housing and retains the sleeves. The passages are arranged in the end wall and are in communication with a channel which extends axially through the drive screw and which opens out at the end of the drive screw located on the suction side, and with channels in the sleeves which pass to chambers located on the end surfaces of the pins. To obtain a seal between, on one hand, the end wall and, on the other hand, the opposing end surface of the housing and the outer end surfaces of the sleeves, a disk-shaped packing is mounted therebetween.

It has been found difficult to obtain a satisfactory seal with this type of pump construction, since the packing is subjected to abnormally high stresses as a result of the fact that an extremely high difference in pressure prevails between the channel and the chambers under high pressure, the chambers being in communication with the pressure side of the pump, and therefore is liable to collapse.

An object of the present invention is to resolve this problem. The invention is characterized by the fact that each of the sleeves in which the pins of the impeller screws are journaled have, on a side thereof remote from the packing and facing a fixed portion of the housing, a deformation zone which abuts the fixed portion. Owing to the fact that when the pump is assembled that portion is partially deformed, there is obtained a positive abutment of the other side of the sleeve against the packing, thereby to provide a good seal.

The invention will now be described in more detail with reference to the accompanying drawings, wherein.

Figures 1, 2, 3, 4:
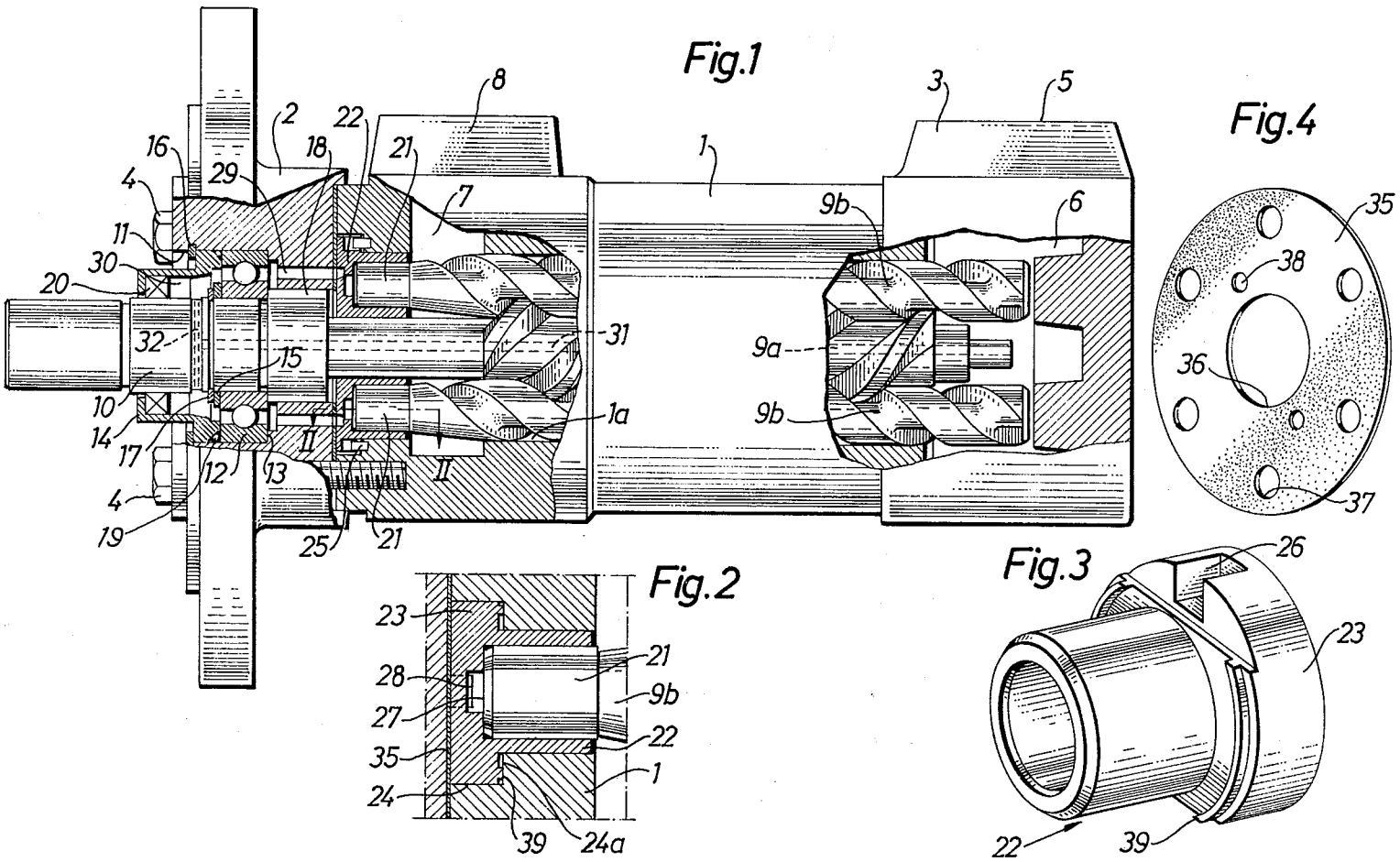
FIG. 1 shows a pump according to the invention in side view and partially in section.
FIG. 2 is a sectional view in larger scale of a portion of the pump taken through the line II in FIG. 1.
FIG. 3 shows in perspective one of the sleeves arranged to accommodate the axial pins of the impeller screws.
FIG. 4 is an end view of a disk-like packing.

The illustrated screw pump includes a housing comprising an externally cylindrical main portion 1 and two end walls 2, 3 which are attached to the main portion in a suitable manner, e.g. by means of bolts, such as those shown at 4 on the end piece 2. The end wall 3 is provided with an inlet 5 and an inlet chamber 6. The end of the main portion 1 remote from the end wall 3 is provided with an outlet chamber 7 and an outlet 8.

Between the inlet chamber 6 and the outlet chamber 7, the main portion 1 has a through passing channel which, in a manner known per se, has the form of three mutually intersecting cylindrical passages (to be explained later) which sealingly enclose the threads of a drive screw 9*a* and two symmetrically arranged impeller screws 9*b*, the threads of which inter-mesh and upon rotation of which liquid is transported from the inlet chamber 6 to the outlet chamber 7, in chambers which are defined by the threads and the walls of the passages 8.

The drive screw 9*a* is integral with a shaft 10 which extends out through a central opening 11 in the end wall 2 and which is adapted to be connected to a drive motor. A ball bearing 12 is arranged around the shaft 10 and supports against a shoulder 13 arranged in the opening 11, against which shoulder the ball bearing is held pressed by a sleeve 14 and a plate 15, which in turn are secured by rings 16 and 17 mounted in grooves in the end wall 2 and the shaft 10 respectively. The ball bearing also supports against the shoulder formed by an enlarged portion 18 of the shaft 10. An O-ring 19 seals between the ball bearing 12, the sleeve 14 and the end wall 2, and packing 20 seals between the shaft 10 and the sleeve 14.

Each impeller screw 9*b* is formed integrally with a pin 21 which is mounted in a sleeve 22 the construction of which is shown more clearly in FIGS. 2 and 3. The sleeve, which sealingly encloses the pin 21, is formed integrally with a plate 23 having the shape of a segment of a circle and mounted in a recess 24 in the end surface of the housing portion 1. A guide pin 25 is mounted in a corresponding hole in the main portion 1 and penetrates a recess 26 in the plate 23, thereby to fix the sleeve in its position.

A small chamber 27 is arranged in the plate 23 and is open at the passage of the sleeve so that it is closed by the end surface of the pin 21 when the pin is inserted in the sleeve. A channel 28 extends through the plate 23 from its outer surface into communication with chamber 27. Through the end wall 2 there extend two axial channels 29 in positions such that when the sleeves 22 are inserted, the inner ends of the channels 29 lie opposite the channels 28. The channels 29 communicate through the ball bearing 12 with a chamber 30 defined by the sleeve 14 around the portion of the shaft 10 surrounded thereby.

An axial channel 31 extends through the hole of the drive screw 9*a* and the shaft 10 from the end of the drive screw located in the inlet chamber 6 to a position level with the chamber 13 where it communicates with said chamber through radial channels 32. In this way the mentioned chambers 27 in the sleeves 22 and adjacent the end of the pins 21 of the impeller screws are in communication with the inlet chamber 6, through channels 28, the channels 29, the ball bearing 12, the chamber 30, the channels 32 and the channels 31. The impeller screws are thus exposed to the pressure prevailing on the suction side at both ends and are therewith relieved from axial forces.

Between, on one hand, the end wall 2, and on the other hand, the end surface of the main portion 1 and the outer surface of the sleeves 22 (the outwardly facing sides of the plates 23) a sealing, a disk-like packing 35 is inserted, the construction of the packing being shown in FIG. 4. The packing has the form of a round plate whose outer diameter corresponds substantially to the diameter of the main portion 1. The packing is provided with a central opening 36 through which the shaft 18 extends, a circle of openings 37 through which bolts 4 extend, and two smaller openings 38 which, when assembling the packing, shall lie opposite to the channels 28 and 29 to permit communication therebetween.

At the outlet side of the pump, i.e. in the chamber 7 and the spaces which communicate therewith, including the opening 36 in the packing 35, there prevails a very high pressure, while the channels 28, and therewith the opening 38, are substantially under the pressure prevailing on the suction side. For the sake of space, these openings must be arranged very close together and under these circumstances it has been found difficult to obtain a satisfactory seal in this area, and that the packing rapidly collapses.

This problem is resolved in accordance with the invention by providing the sleeve 22 on the surface of the plate 23 remote from the packing 35 and facing the bottom surface 25*a* of the recess 24 with a defermation zone in the form of an edge 39, the radial extension of which from the plate 23 in the starting position, i.e. prior to being assembled, is somewhat greater than the intended distance between the surface 24*a* and the opposite surface of the plate 23, so that upon assembly it is slightly deformed. It has been found that in this way the sleeve can be held in positive abutment with the packing 35, thereby to provide a good seal and to increase the useful life of the packing.

The edges 39 may be swaged or upset with or may be turned on a lathe, cast in a mould or produced in some other suitable way.

I claim:

1. A screw pump having a screw unit which comprises a drive screw (9*i*) and at least one impeller screw (9*b*) meshing therewith, a housing 19) sealingly enclosing said screws; said impeller screws on the pressue side of the pump being provided with pins (21) mounted in sleeves (22), the interiors of which communicate with the suction side of the pump through channels (28, 29, 31, 32) in said pump housing and in said drive screw; to relieve axial forces on said impeller screws; a disc-like packing (35) mounted between an end surface of each sleeve and an end wall (2) of said housing which said wall closes the pressure side of said housing, through which end wall and packing said channels partially extend, and through which a drive shaft (10) for said drive screw is extended; wherein said sleeves are provided with at least one deformation zone (39) on sides thereof remote from said packing, and facing a fixed surface in said housing, the zones being arranged to abut and seal said fixed surface in the housing.

* * * * *